United States Patent [19]

Iida et al.

[11] 4,239,483

[45] Dec. 16, 1980

[54] METHOD OF CONTROLLING STEEL STRIP TEMPERATURE IN CONTINUOUS HEATING EQUIPMENT

[75] Inventors: Hiroshi Iida; Ikuo Umehara; Yasuo Takeda, all of Himeji, Japan

[73] Assignee: Nippon Steel Corporation, Tokyo, Japan

[21] Appl. No.: 91,818

[22] Filed: Nov. 6, 1979

Related U.S. Application Data

[63] Continuation of Ser. No. 950,521, Oct. 11, 1978, abandoned.

[30] Foreign Application Priority Data

Oct. 20, 1977 [JP] Japan ..... 52/125092

[51] Int. Cl.[3] ..... F27B 9/28; C21D 9/54

[52] U.S. Cl. ..... 432/8; 266/103; 432/51; 432/54; 432/59

[58] Field of Search ..... 432/8, 51, 54, 59; 266/103

[56] References Cited

U.S. PATENT DOCUMENTS

| | | | |
|---|---|---|---|
| 2,278,136 | 3/1942 | Otis et al. | 432/59 |
| 3,252,693 | 5/1966 | Nelson | 266/103 |
| 4,165,964 | 8/1979 | Yonezawa et al. | 432/59 |

*Primary Examiner*—John J. Camby

*Attorney, Agent, or Firm*—Wenderoth, Lind & Ponack

[57] ABSTRACT

A method of controlling steel strip temperature in a process of continuously heating steel strip in heating equipment having a preheating zone and a rapid-heating zone. The preheating zone has a number of gas-injecting preheating units that can be individually put into and taken out of operation. In normal operation, the in-operation length of the preheating zone is prefixed irrespective of strip thickness, and the temperature of the rapid-heating zone is preset depending on the strip thickness so that the strip acquires the desired temperature at the exit end thereof. In such operation, the strip is preheated in the preheating zone of the prefixed in-operation length and rapidly heated in the rapid-heating zone at the preset temperature. In irregular operation, such as treating a following strip the thickness of which has changed, the temperature of the rapid-heating zone is changed from the preset one to a second one optimum for the following strip. In the transition period in which the preset temperature of the rapid-heating zone changes to the second one, the in-operation length of the preheating zone is adjusted to control the strip temperature at the exit end thereof. Thus the desired strip temperature at the exit end of the rapid-heating zone can be achieved irrespective of strip thickness.

9 Claims, 39 Drawing Figures

METHOD OF CONTROLLING STEEL STRIP TEMPERATURE IN CONTINUOUS HEATING EQUIPMENT

This application is a Continuation of application Ser. No. 950,521, now abandoned.

BACKGROUND OF THE INVENTION

This invention relates to a method of controlling the temperature of steel strip in continuous heating equipment and, more particularly, to a method of controlling the temperature of steel strip in continuous heating equipment such as a continuous annealing line.

Specifically, the invention relates to a method of controlling the temperature of steel strip in continuous heating equipment in which strips of different thickness, but with approximately the same temperature, and welded together at the entry end of the equipment, are continuously transported therethrough at a given speed, and heated to a desired temperature at the exit end thereof irrespective of the strip thickness.

Generally, continuous heating furnaces are used for continuously annealing steel strip. Specific heating patterns are established to impart desired formabilities to the strip material. Each heating pattern has a desired ultimate temperature to which the strip should be heated or with which the strip should leave the exit end of the continuous heating furnace irrespective of strip thickness.

Such heating furnaces can be broadly classified into those which are heated electrically (either by direct excitation or by induction heating) and those heated by burning fuel gas. The gas-fired furnaces can be subclassified into the radiant-tube type and the direct-fired non-oxidizing atmosphere type.

Considering energy efficiency, running cost, initial investment and other factors, the gas-fired furnaces are much more advantageous than the electrically heated ones.

When continuously heat-treating strips of different thickness, it is a common practice to weld them together on a welder before feeding them to the heating furnace. Even when the strip thickness changes like this, the strip temperature at the exit end of the heating furnace should be maintained unchanged.

Conventionally, the exit-end temperature of such differential-thickness strip has been controlled by adjusting the temperature of the continuous heating furnace (i.e., the temperature of the furnace atmosphere).

For example, in a radiant-tube furnace with a regular heating rate of 15° C. per second, the exit-end temperature of the differential-thickness strip can be satisfactorily controlled by said furnace temperature adjustment. Because the furnace temperature need not be changed extensively, only a short length of the strip fails to reach the desired exit-end temperature, creating no yield problem.

Recently, however, methods have been proposed to heat the strip at a rapid rate such as 100° C. per second or above in a continuous-annealing process, the object of which is to obtain cold-rolled strip with excellent formability. In such high-speed operations, the furnace temperature cannot be adjusted as quickly as required, so that the incorrectly heated portion in the strip increases and a yield problem arises.

This decreased yield problem will be explained with a concrete example. Let it be assumed that strip having a thickness of 0.6 mm is heated within a given range (e.g. from approximately 700° C.) in a heating furnace of a given length (e.g., 20 m), while being transported at a fixed speed of 400 m per minute. Within the above heating range, the strip is heated at a rate of 100° C. per second to attain a constant temperature of 700° C. at the exit end of the furnace. When the strip thickness changes from 0.6 mm to b 0.4 mm, the above operating conditions cannot be maintained unless the preset furnace temperature is changed by 100° C. With such a temperature adjustment due to the changes in thickness of the strip, approximately 20 m of the strip will be heated to a temperature which deviates from the desired temperature. The tail end of one strip and the head end of the next strip welded thereto will have an off-gauge portion of approximately 10 m each on both sides of the weld. The above-mentioned incorrectly heated length should ideally correspond to the total length of the off-gauge portions on both sides of the weld. To confine the incorrectly heated length within this off-gauge length, the 100° C. adjustment in the furnace temperature should be accomplished in 3 seconds. But such a quick change cannot be achieved using existing techniques and equipment.

For example, a continuous heating furnace with an ordinary furnace temperature control system will require 5 to 10 minutes to complete the 100° C. adjustment in the furnace temperature. Consequently, the length of the strip which fails to reach the desired temperature is 2000 m to 4000 m, which means that a considerable length of strip having an acceptable thickness must be discarded as scrap due to having been improperly heated.

Even when the welded strip does not contain any off-gauge portion, the incorrectly heated part, of course, must be scrapped. The off-gauge length depends on the accuracy of the automatic gauge control system of the cold tandem mill.

SUMMARY OF THE INVENTION

This invention offers a method for successfully obviating these difficulties in controlling the strip temperature in the heat treating process.

An object of this invention is to provide a strip temperature control method suited for continuously heating strip at much higher rates than is conventional.

Another object of this invention is to provide a precise strip temperature control method that insures constantly achieving a desired strip temperature with minimal energy consumption, irrespective of strip thickness.

A further object of this invention is to provide a strip temperature control method that permits decreasing the length of the heating line and increasing the heating speed.

A still further object of this invention is to provide a strip temperature control method that assures production of good-quality strip and decreases the incorrectly heated length during continuous annealing.

To achieve these objects, the strip temperature control method of this invention, which is applicable to heating equipment having a preheating zone and a subsequently rapid heating zone, through which different thickness strip prepared by welding together strips of different thickness is continuously transported at a fixed speed so that the strip temperature constantly reaches a given desired temperature at the exit end of the rapid-heating zone irrespective of strip thickness, has the following features:

(1) The preheating zone comprises a number of individually controllable preheating units for directing heating gas against the strip, disposed adjacent to each other in the direction of strip travel.

(2) The in-operation length of the preheating zone is prefixed corresponding to the thickness of the strip initially being heated.

(3) The temperature of the rapid-heating zone is preset according to thickness of the strip intially being heated so that the strip constantly acquires the desired temperature at the exit end thereof.

(4) In the regular operation of transporting strip of uniform thickness, the strip is preheated in the preheating zone of the prefixed in-operation length and then rapidly heated in the rapid-heating zone kept at the preset temperature, to attain the desired temperature at the exit end thereof.

(5) Finally, in irregular operation, such as transporting strip having a changed thickness, the preset temperature of the rapid-heating zone is changed from one for the initially heated strip to a second one optimum for the changed thickness strip. During the transitional period in which the actual temperature of the rapid-heating zone changes to the second preset level, the in-operation length of the preheating zone is adjusted to control the strip temperature at the exit end thereof. By this means, the strip will attain the desired temperature even during the transitional period.

BRIEF DESCRIPTION OF THE DRAWINGS

In the drawings:

FIG. 4A shows the case in which the strip thickness decreases and FIG. 4B shows the case wherein the strip thickness increases;

FIGS. 6A and 6B illustrate the case in which the in-operation length of the preheating zone is instantaneously adjusted as the thickness-change point reaches the entrance thereof; FIGS. 6C and 6D show the case in which the in-operation length of the preheating zone is instantaneously adjusted as the thickness-change point reaches the exit thereof;

DETAILED DESCRIPTION OF THE INVENTION

Figure 1:
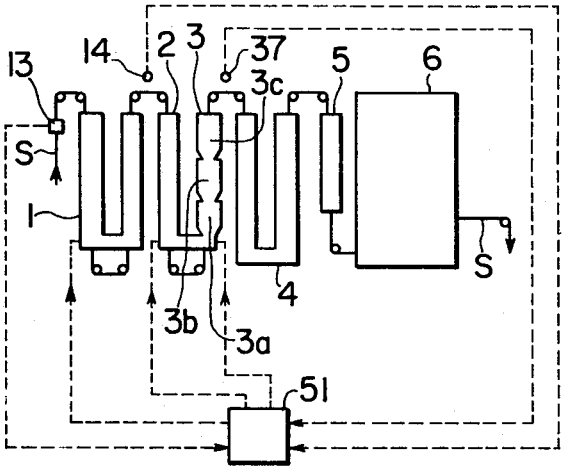
FIG. 1 is a schematic diagram of a continuous annealing line employing the strip temperature control method of this invention.

The method of controlling the strip temperature in the continuous heating line according to this invention will now be described in detail.

To achieve the strip temperature control method of this invention, the following requirements must be fulfilled:

(1) The continuous heating equipment must have a preheating zone and a rapid-heating zone, whether it is of the type in which two or more independent furnaces are combined in series or a single independent furnace type.

(2) The preheating zone must have a plurality of gas-injecting preheating units than can be individually placed in and taken out of operation at will. By turning the gas-injecting preheating units on and off, the effective length of the preheating zone (hereinafter called the in-operation length of the zone) contributing to elevating the strip temperature can be adjusted as required. For example, a preheating zone having an actual zone length of 42 m may be divided into preheating units each 2 to 3 m long. To perform good strip temperature control, it is preferable that the preheating zone be divided into as many units as possible, each unit having an equal heating capacity, and the temperature of the injected gas be as low as approximately 400° C. to 500° C. The low-temperature gas can be supplied and shut off with a simple on-off mechanism. The most important advantage is elimination of delayed response in the control of strip temperature at the exit end of the preheating zone due to the heat accumulated in the furnace structure. The gas-injecting preheating method permits attaining high-level heat transfer with the low-temperature gas that is advantageous from the viewpoint of furnace design, operation and strip temperature control.

(3) The rapid-heating zone has an ordinary furnace temperature control system. To increase the temperature controllability, it is preferred that the rapid-heating zone be subdivided into several zones the temperature of which can be controlled individually.

(4) In regular operation, a strip of uniform thickness, except some portions in the vicinity of any welds where the thickness may vary, is transported at a constant speed. In the rapid-heating zone, the strip is heated at a rate of 100° C. per second (e.g., from 400° C. to 700° C.) or above to attain the desired strip temperature (e.g., 700° C.) at the exit end thereof. This operation, which has a relatively high time constant, is controlled mainly by regulating the temperature of the rapid-heating zone. When transporting different thickness strip or a change of thickness portion in the vicinity of the weld, or in an emergency irregular operation, the strip should be heated at a rate of 100° C. per second or above to the desired temperature (e.g., 700° C.) in a short time. This operation, which has a relatively low time constant, is controlled mainly by adjusting the number of the preheating units in operation.

Now these procedures will be described in more detail.

(a) In a regular operation of transporting strip of uniform thickness at a constant speed, the in-operation length of thickness the preheating zone can be fixed (corresponding to the strip thickness to be treated initially so as to be approximately equal (e.g., 80 percent or more) to the actual length thereof for effective heat utilization. Where higher temperature controllability is required, the in-operation length may be reduced, for example, to 50 percent of the actual length (corresponding to the changed strip thickness). This in-operation length will hereafter be called the preset in-operation length.

(b) The strip is preheated in the preheating zone with the preset in-operation length. Then it passes through the rapid-heating zone at said speed, where it is heated at a rate of, for example, 100° C. per second so that it attains the desired temperature at the exit end thereof. Optimum rapid-heating zone temperatures are established previously for individual strip thicknesses.

The object of establishing the rapid-heating zone temperature corresponding to strip thickness is to reduce energy consumption. If a rapid-heating zone temperature set to attain the desired temperature for a strip of maximum thickness at said transporting speed is maintained, it may be possible to bring thinner strips the same desired temperature by reducing the in-operation length of the preheating zone. But maintenance of the high temperature for the maximum-thickness strip during transporting thinner strips requires more fuel than is really necessary. The result if a considerable energy loss.

(c) In this regular operation, the strip is preheated in the preheating zone with the preset in-operation length, and then rapidly heated in the rapid-heating zone at an optimum temperature corresponding to the thickness thereof so that the desired strip temperature is obtained at the exit end thereof.

In irregular operation of transporting the change of thickness point of the strip or the like, the optimum rapid-heating zone temperature for the initial thickness, or preceding, strip is changed to a second optimum temperature pre-established for the changed thickness, or succeeding, strip. During the transistion period in which the actual rapid-heating zone temperature gradually changes to the second optimum temperature, the in-operation length of the preheating zone is changed by adjusting the number of the preheating units in operation, thus controlling the strip temperature at the exit end of the preheating zone. By this means, the strip will have the desired temperature at the exit end of the rapid-heading zone even during the transition period during which the actual rapid-heating zone temperature is changing.

Further, an embodiment of this invention (1) employs a direct-fired non-oxidizing furnace as the rapid-heating zone which produces a non-oxidizing atmosphere by the adjustment of the air-fuel ratio, and (2) uses waste combustion gas emitted from the subsequent rapid-heating zone as the low-temperature gas injected in the preheating zone, thus reducing energy consumption. Additional energy saving is achieved by employing 80 percent or more of the actual preheating zone length during regular operation.

Next, a heating furnace in which the strip temperature control method of this invention itself can be carried out will be described more concretely and in further detail.

In the schematic diagram of FIG. 1 showing a continuous annealing line for carrying out the strip temperature control method according to this invention, strip S is continuously fed from entry-end equipment (not shown) comprising payoff reels, a welder and entry looper, and is threaded through No. 1 preheating zone 1, No. 2 preheating zone 2, rapid-heating zone 3, soaking zone 4, primary cooling zone 5, overaging zone 6 and a secondary cooling zone (not shown) into the exit-end equipment (not shown) comprising an exit looper and tension reels.

Figure 2:
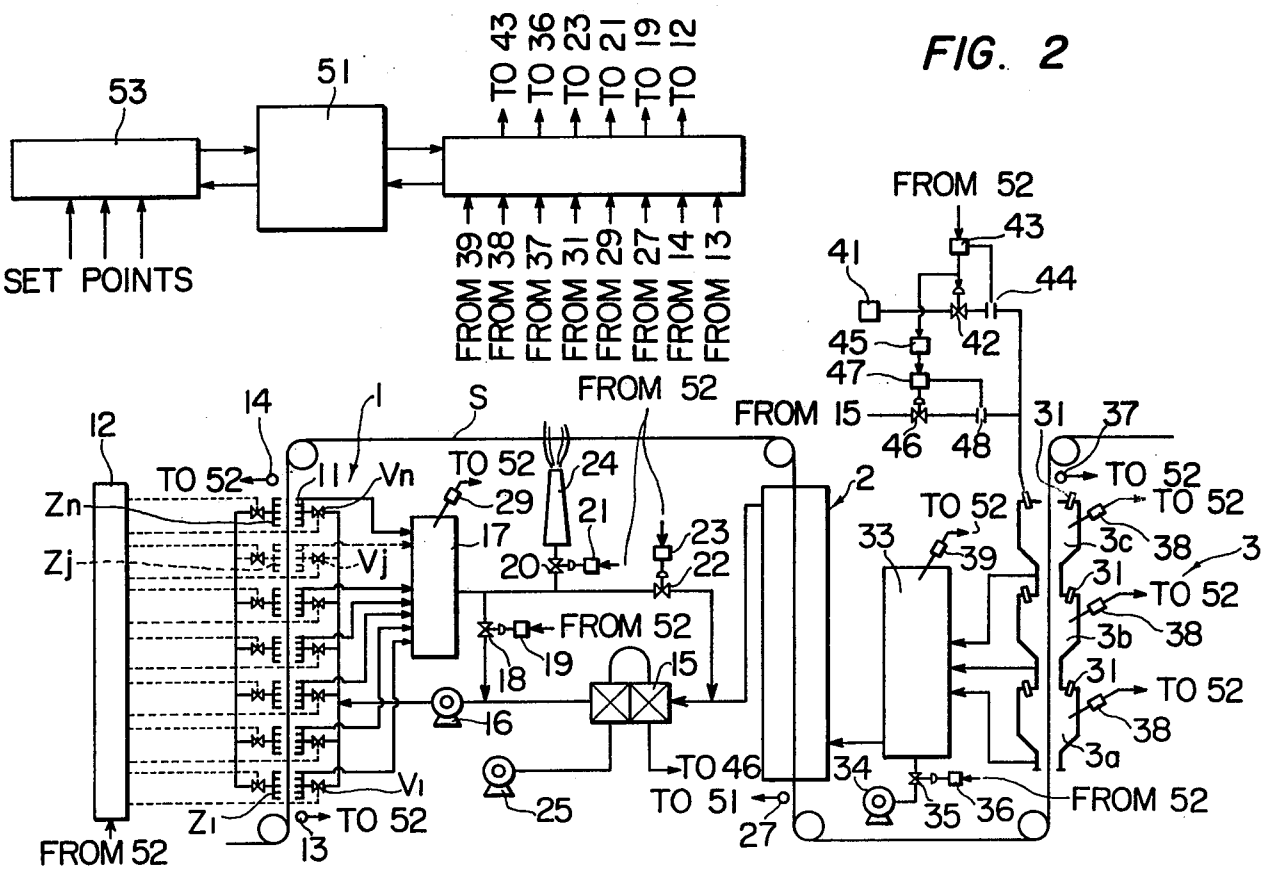
FIG. 2 is a detailed schematic diagram of the preheating and rapid-heating zones of FIG. 1.

FIG. 2 shows details of the No. 1 preheating zone 1, No. 2 preheating zone 2 and rapid-heating zone 3 of FIG. 1. Following the flow of heating gas, the rapid-heating zone 3 will be described first. To enhance its controllability, the rapid-heating zone 3 consists of No. 1 zone 3*a*, No. 2 zone 3*b* and No. 3 zone 3*c* that are combined together in series. As will be described later, the temperature of each zone is controlled independently. In these zones 3*a*, 3*b* and 3*c*, the strip S is heated by the combustion gas injected into the zones from the burners 31.

After heating the strip S, the combustion gas in the rapid-heating zone 3 is collected in a waste-gas collecting chamber 33 where its temperature is adjusted to the desired level by being mixed with atmospheric air or other lower temperature gas from a blower 34. This waste gas is then supplied to the No. 2 preheating zone 2, where the strip S is heated from approximately 250° C. to approximately 400° C. by making effective use of the unburned fuel and the sensible heat of the waste gas from the rapid-heating zone 3.

As shown in FIG. 2, the No. 1 preheating zone 1 is divided into 28 to 42 preheating units Zi. Each preheating unit Zi has nozzles 11 that direct high-speed heating gas against the strip S in a direction perpendicular to the strip. The nozzles 11 are connected to an on-off regulating valve Vi controlled by a control computer 51. Accordingly, each preheating unit Zi can be independently put into or taken out of operation at will. Owing to the above heating-gas in injecting method, the No. 1 preheating zone can achieve a high-level of heat transfer even with low-temperature gas. This embodiment utilizes the waste gas from the No. 2 preheating zone 2 as said heating gas. The waste gas leaving the exit end of the No. 2 preheating zone 2 passes through a recuperator 15 and a hot blower 16 into the No. 1 preheating zone 1. The waste gas from the No. 1 preheating zone 1 is first collected in a waste-gas collecting chamber 17. Passing through a flow-rate regulating valve 18, part of the gas is then mixed with the waste gas from the No. 2 preheating zone 2. Part of the remaining gas is discharged through a flow-rate regulating valve 20 and a smokestack 24 into the atmosphere. The remainder flows through a flow-rate regulating valve 22 and becomes mixed with the waste gas from the No. 2 preheating zone 2. The temperature of the heating gas in the No. 1 preheating zone 1 is controlled by thus regulating the quantity of the waste gas discharged into the atmosphere by the regulating valve 20 and the quantity of the waste gas mixed with that from the No. 2 preheating zone 2 by the regulating valves 18 and 22. When put in operation, each preheating unit Zi has substantially equal strip heating capacity. Cold air to other gas from a cold blower 25 is heated in the recuperator 15 and supplied to the burners 31 in the rapid-heading zone 3.

During regular operation in which strip of uniform thickness is transported, except some portions in the vicinity of its welds where strip thickness may vary, at constant speed, 80 percent or more of the preheating units in the No. 1 preheating zone are put in operation. Namely, 80 percent or more of the actual zone length is used as the effective preheating zone contributing to strip preheating.

As can be understood, the preheating zones 1 and 2 are designed to reduce energy consumption, making effective use of the sensible heat of the waste gas emitted from the rapid-heating zone 3.

In the entry-end equipment, the preceding strip stored in the looper is continuously paid off. The tail end of the preceding strip and the head end of the following strip are welded together on the welder so that they are paid off continuously.

The preceding and following strips welded together have certain thicknesses within the range of 0.3 to 1.2 mm. Generally, a heating schedule is established which reduces the thickness difference between the strips to a minimum. In some irregular instances, however, a large difference may be involved.

At the entrance of the No. 1 preheating zone 1, the strip has a fixed temperature, e.g., 20° C., irrespective of thickness.

The strip S is transported at a speed (e.g., 400 m per minute) which is fixed irrespective of strip thickness which permits heating the strip at a rate of 100° C. per second or above and the furnace temperature is established corresponding to the specific strip thickness. This transporting speed is preset, and therefore it is called the preset transporting speed.

Figure 3:
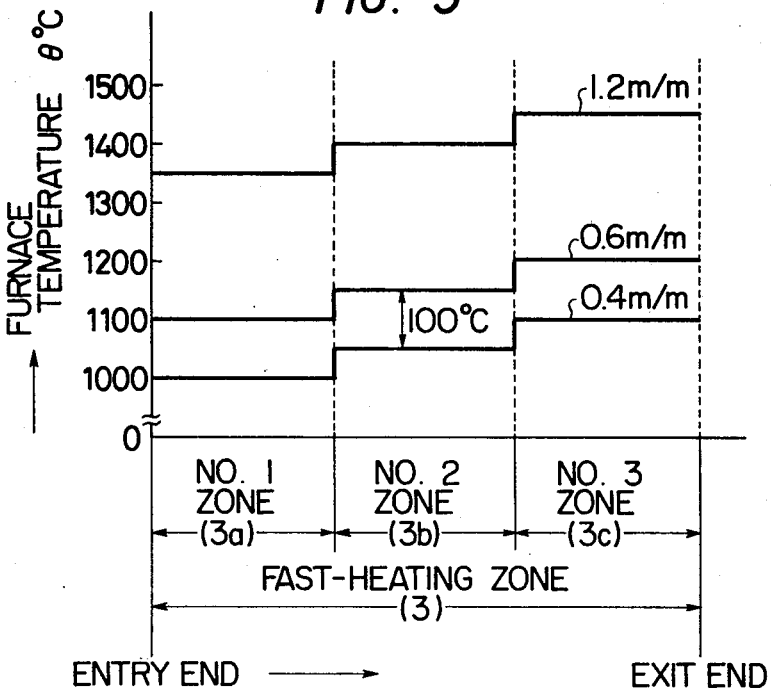
FIG. 3 is a diagram of optimum preset rapid-heating zone temperatures for different strip thicknesses.

FIG. 3 shows optimum temperature patterns in the rapid heating zone 3 that are applicable when 80 percent or more of the No. 1 preheating zone 1 is put in operation. With these temperatures, strips 0.4, 0.6 and 1.2 mm thick can be heated at a rate of 100° C. or above, at least from 400° C. to 700° C. The transporting speed and the desired temperature at the exit end of the rapid-heading zone are then fixed as described above corresponding to strip thickness. Here the term "optimum" means the most favorableness to energy saving.

Now the strip temperature control method of this invention will be described with reference to FIGS. 4A and 4B.

Figure 4A:
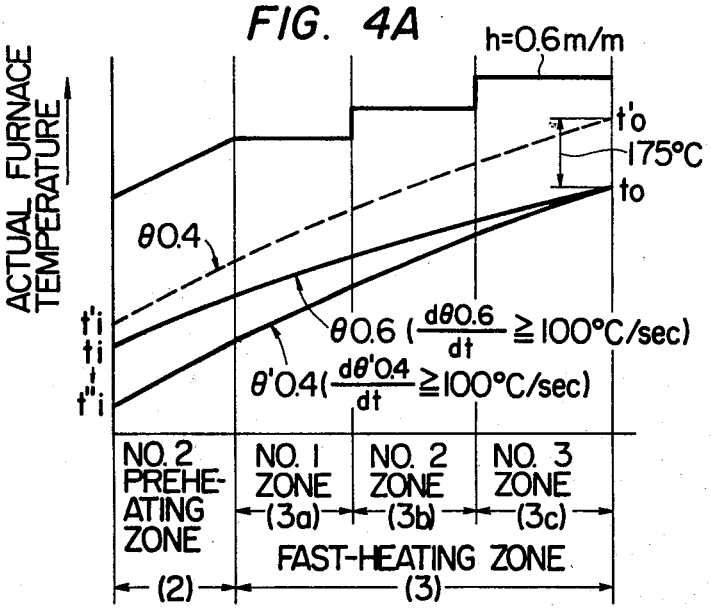
FIGS. 4A and 4B are diagrams which schematically illustrate temperature control of differential-thickness strip according to this invention.
Figure 4B:
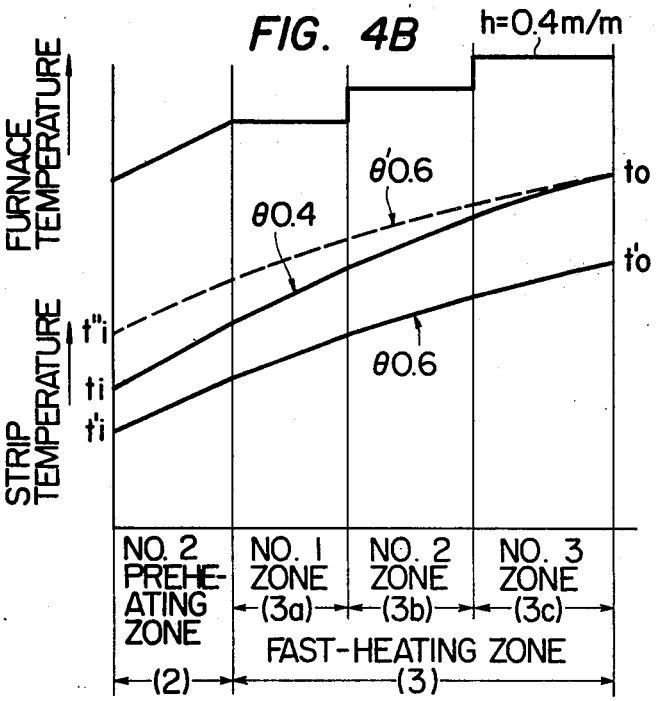

In FIGS. 4A and 4B, the lengths of the No. 2 preheating zone 2 and the rapid-heating zone 3 are plotted in the direction of the x-axis, and the actual furnace and strip temperatures along the y-axis.

The principal object of this invention is to control the temperature of different-thickness strip. But the controlling mode differs somewhat depending on whether 80 percent or more of the No. 1 preheating zone 1 or 50 percent thereof is put in operation.

Refernce will be made first to the case where the in-operation zone length is 80 percent or more. This operation can be divided into two sub-cases: (1) heavy-gauge strip is followed by light-gauge strip, and (2) light-gauge strip is followed by heavy-gauge strip. There are some operational differences between the two cases.

EXAMPLE 1

First, the case in which heavy-gauge strip is followed by light-gauge strip will be described with reference to FIG. 4A.

In FIG. 4A, line h represents the optimum preset and actual temperature of the rapid-heating zone 3 and the actual temperature of the No. 2 preheating zone 2 for 0.6 mm thick strip transported at the preset transporting speed. $\theta_{0.6}$ designates a heat-up curve for the 0.6 mm thick strip in the No. 2 preheating zone 2 and the rapid-heating zone 3, after being preheated in the No. 1 preheating zone 1 with a preset in-operation length. ti is the temperature of the 0.6 mm thick strip at the exit end of the No. 1 preheating zone 1 (or the entry end of the No. 2 preheating zone 2). to is the desired final temperature of the 0.6 mm thick strip at the exit end of the rapid-heating zone 3. The strip heating rate is expressed as $d\theta_{0.6}/dt \approx 100°$ C./sec.

If the change of thickness strip is transported while not changing the conditions in the zones 1, 2 and 3 or the transporting speed, 0.4 mm thick strip leaves the No. 1 preheating zone 1 with a temperature t'i that is higher than ti. In the No. 2 preheating zone 2, the strip temperature rises along the dotted line curve $\theta_{0.4}$. Thus the strip leaves the rapid-heating zone 3 with a temperature that is approximately 175° higher than the desired temperature to. When welded different-thickness strip is continuously transported without changing the transporting speed, it is impossible to offset a temperature difference as great as 175° C. by adjusting the temperature of the rapid-heating zone 3.

Even if the furnace temperature control system instantaneously switches to change the temperature of the rapid-heating zone 3 from one preset for 0.6 mm to one for 0.4 mm, the actual temperature therein does not change very quickly. During this transition period, the strip temperature at the exit end of the rapid-heating zone 3 deviates from the fixed desired temperature. The faster the transporting speed, the greater will be the length subjected to incorrect temperatures and the greater the yield reduction.

According to this invention, the in-operation length of the No. 1 preheating zone 1 is instantaneously shortened when the 0.4 mm thick strip reaches, for example, the entry end of the No. 1 preheating zone 1, by adjusting the number of the preheating units in operation. By this step, the strip temperature at the entry end of the No. 2 preheating zone 2 (or the exit end of the No. 1 preheating zone 1) is lowered to t''i in FIG. 4A to offset the above-described difference of 175° C. Consequently, the desired temperature to is obtained at the exit end of the rapid-heating zone 3, even if the actual temperature in the No. 2 preheating zone 2 and the rapid-heating zone 3 remains at the optimum level preset for the 0.6 mm thick strip.

As the 0.4 mm thick strip moves through the zones 1, 2 and 3, the temperature control system switches the preset temperature of the rapid-heating zone 3 from one for 0.6 mm to that for 0.4 mm.

Following this switching, the actual temperature in the rapid-heating zone 3 begins to drop toward the optimum temperature preset for the 0.4 mm thick strip. To insure that the 0.4 mm thick strip transported during this transitional period also attains the desired temperature at the exit end of the rapid-heating zone 3, the in-operation length of the No. 1 preheating zone 1 is increased by adjusting the number of the preheating units in operation. By this means, the strip temperature at the exit end of the No. 1 preheating zone 1 (or the entry end of the No. 2 preheating zone 2) is controlled. Finally, the in-operation length of the No. 1 preheating zone 1 is returned to the original preset length. Therefore, the 0.4 mm thick strip is now preheated in the No. 1 preheating zone 1 with the preset in-operation length, and rapidly heated in the rapid-heating zone 3 the temperature of which is maintained at the optimum temperature preset so that the 0.4 mm thick strip attains the desired temperature at the exit end of the rapid-heating zone 3.

The procedure for carrying out this strip temperature control will be described more specifically with reference to FIG. 5.

Figure 5:
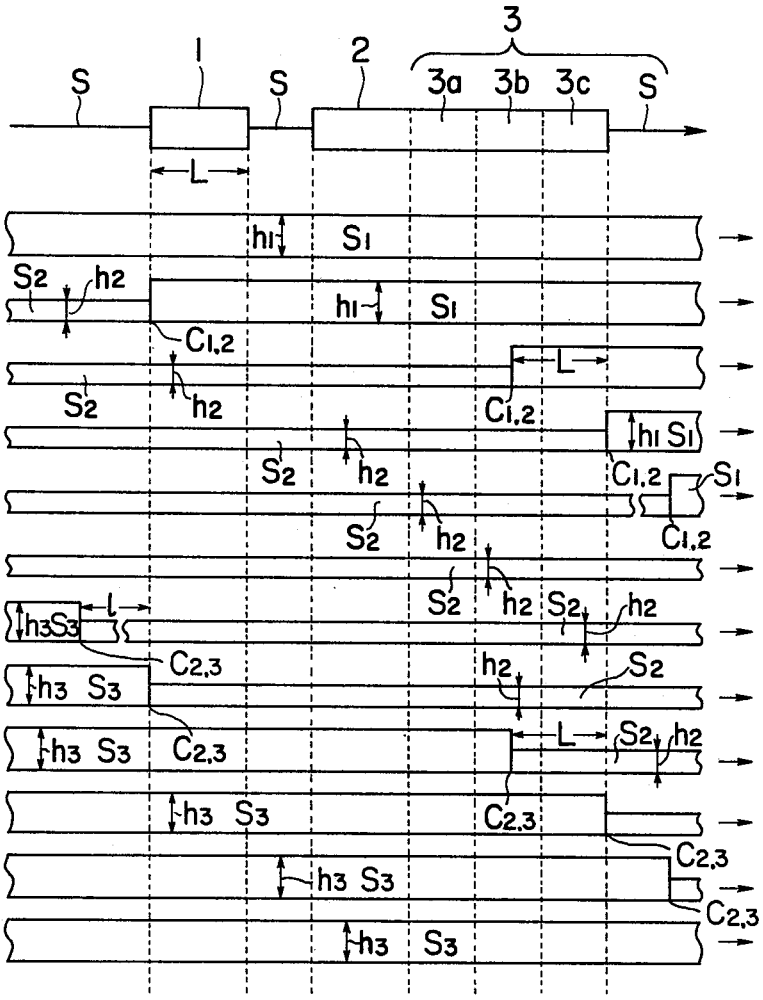
FIG. 5 is a diagram illustrating the strip temperature control method of this invention, showing the timing of the operation that changes with the movement of the thickness-change point.

FIG. 5 is a block diagram showing the movement of the thickness-change points of the strip S continuously transported in the direction of the arrow through the No. 1 preheating zone 1, No. 2 preheating zone 2 and rapid-heating zone 3 arranged in series as shown in FIG. 2. In this figure, $S_1$ designates a strip with a thickness $h_1$, and $S_2$ denotes another strip with a thickness $h_2$ the head end of which is welded to the tail end of the strip $S_1$ (here $h_1=0.6$ mm and $h_2=0.4$ mm). $C_{1,2}$ is the weld between the strips $S_1$ and $S_2$ where the strip thickness changes. The strip $S_2$ enters each zone after the strip $S_1$, so the strips $S_1$ and $S_2$ are called the preceding and following strips, respectively.

The strip S travels at a preset transporting speed Vc (fixed).

Step 1 (time $t_1$)

The strip $S_1$ with the thickness $h_1$ travels through the zones 1, 2 and 3 at the speed Vc. This is a regular operating condition. At this time, 80 percent or more of the actual length of the No. 1 preheating zone 1 is in operation, contributing to preheating the strip $S_1$. The furnace temperature control system controls the actual temperature of the rapid-heating zone 3 at the optimum level preset for the strip $S_1$. Therefore the strip $S_1$ attains the desired temperature at the exit end of the rapid-heating zone 3.

Step 2 (time $t_2$)

When the thickness-change point $C_{1,2}$ reaches the entry end of the No. 1 preheating zone 1, the in-operation length thereof is instantaneously made shorter than the preset in-operation length. The in-operation length is shortened to such extent that the following strip $S_2$ after the thickness-change point $C_{1,2}$ is preheated to a temperature at the exit end of preheating zone 1 that assures attainment of said desired temperature at the exit end of the rapid-heating zone 3, even if the preset and actual temperatures of the rapid-heating zone 3 are the optimum for the strip $S_1$ rather than the strip $S_2$.

More specifically, the temperatures of the strip $S_2$ at the entry end of the No. 2 preheating zone 2 and rapid-heating zone 3 are established so that the strip $S_2$ with the thickness $h_2$, heated in the rapid-heating zone 3 the temperature is controlled to a level optimum for the strip $S_1$ with the thickness $h_1$, will nevertheless attain the desired temperature at the exit end of the rapid-heating zone 3. The in-operation length of the No. 1 preheating zone 1 required for attaining said strip temperature is determined from the required length and the preset length.

At time $t_3$ in FIG. 5, that point on the preceding strip $S_1$ which is ahead of the thickness-change point $C_{1,2}$ by the actual length L of the No. 1 preheating zone 1 reaches the exit end of the rapid-heating zone 3.

The preceding strip $S_1$ leaving the rapid-heating zone 3 between times $t_2$ and $t_3$ attains the desired temperature.

At time $t_4$ in FIG. 5, the thickness-change point $C_{1,2}$ reaches the exit end of the rapid-heating zone 3. At some time, such as $t_5$, after $t_4$, the following strip $S_2$ behind the thickness-change point $C_{1,2}$ leaves the rapid-heating zone 3 with the desired temperature, even if actual temperature of zone 3 remains optimum for the preceding strip $S_1$.

Step 3 (any time after $t_4$)

When the following strip $S_2$ has occupied all zones 1, 2 and 3, the temperature control system switches to the preset temperature for the rapid-heating zone 3 from one optimum for the strip $S_1$ with the thickness $h_1$ to one for the strip $S_2$ with the thickness $h_2$ at a suitable time. Also, action to increase the inoperation length of the No. 1 preheating zone 1 is started.

Even when the control system switches to the preset temperature to one optimum for the strip $S_2$, the actual zone temperature does not respond or change instantaneously. Therefore, actual change of temperatures in the rapid-heating zone 3 and No. 2 preheating zone 2, the temperature of the strip $S_2$ leaving the exit end of the rapid-heating zone 3 during this transition period, and the temperature of the strip $S_2$ at the exit end of the No. 1 preheating zone 1 necessary for attaining the desired temperature at the exit end of the rapid-heating zone 3 during the transition period are estimated. Based on the results of the estimation, the in-operation length of the No. 1 preheating zone 1 is increased. At the same time, the temperature of the strip $S_2$ at the exit end of the rapid-heating zone 3 and/or the exit end of the No. 1 preheating zone 1 is measured and fed back to the No. 1 preheating zone 1 as information for the control of the in-operation length thereof. The change in actual furnace temperature resulting from the switching of the preset temperature is offset by the adjustment of the in-operation length of the No. 1 preheating zone 1 on the basis of said estimation and feedback. Consequently, the following strip $S_2$ leaving the rapid-heating zone 3 during the transition period, in which the actual furnace temperature changes from the one preset for the strip $S_1$ with the thickness $h_1$ to that for the strip $S_2$ with the thickness $h_2$, can attain the desired temperature.

Step 4 (time $t_6$)

When a stable condition (time $t_6$), in which the strip $S_2$ having the thickness $h_2$ is constantly transported through all zones, is reached, the actual temperature in the rapid-heating zone 3 settles at the level optimum for the strip $S_2$ and the in-operation length of the No. 1 preheating zone 1 returns to the preset one that is 80 percent or more of the actual zone length.

Next, an operation in which light-gauge strip is followed by heavy-gauge strip will be described with reference to FIG. 4B. In this figure, line h represents the optimum preset and actual temperature of the rapid-heating zone 3 for heating 0.4 mm thick strip transported therethrough at the preset speed. $\theta_{0.4}$ designates a heat-up curve for the 0.4 mm thick strip that is preheated in the No. 1 preheating zone with said preset in-operation length and which then enters the No. 2 preheating zone 2 and the rapid-heating zone 3 with a temperature ti. to is the desired temperature and the temperature of the 0.4 mm thick strip at the exit end of the rapid-heating zone 3.

A 0.6 mm thick strip, after being preheated in the No. 1 preheating zone 1 with said preset in-operation length, enters the No. 2 preheating zone 2 and rapid-heating zone 3 with a temperature t'i that is lower than ti. Then the strip temperature rises along a curve $\theta_{0.6}$ that is lower than $\theta_{0.4}$. The strip leaves the rapid-heating zone 3 with a temperature t'o that is lower than the desired temperature to.

The temperature t'o may be raised to temperature to by raising the temperature of the 0.6 mm thick strip at the exit end of the No. 1 preheating zone 1 to t'i to follow a curve $\theta_{0.6}$. But the strip temperature at the exit end of the No. 1 preheating zone 1 cannot be raised by increasing the in-operation length thereof because the preset in-operation length is substantially critical.

Therefore, the furnace temperature control system switches the preset temperature from one for the 0.4 mm thick strip to one for the 0.6 mm thick strip while the 0.4 mm thick strip is still being transported through the zones 1, 2 and 3. Following this switching, there is a transistion period during which the actual temperature in the rapid-heating zone 3 gradually rises toward the one preset for the 0.6 mm thick strip. To insure that the 0.4 mm thick strip attains the desired temperature at the exit end of the rapid-heating zone 3 during said transistion period, the in-operation length of the No. 1 preheating zone 1 is shortened by adjusting the number of the preheating units in operation, thus controlling the strip temperature at the exit end of the No. 1 preheating zone (or the entry end of the No. 2 preheating zone 2). The actual temperature of the rapid-heating zone 3 is raised to the optimum level preset for the 0.6 mm thick strip before the 0.6 mm thick strip reaches the entry end of the No. 1 preheating zone 1. Then, the shortened in-operation length of the No. 1 preheating zone 1 is instantaneously returned to the preset in-operation length as the 0.6 mm thick strip reaches, for example, the entry end of the No. 1 preheating zone 1. Accordingly, the 0.6 mm thick strip is now preheated in the No. 1 preheating zone 1 with the preset in-operation length, and rapidly heated in the rapid-heating zone 3 the actual temperature of which is maintained at the optimum temperature for the 0.6 mm thick strip so that the strip attains the desired temperature at the exit end of the rapid-heating zone 3.

The procedure for this strip temperature control will be described more specifically with reference to FIG. 5.

In this figure, $S_3$ designates strip with a thickness $h_3$ the forward end of which is welded to the tail end of the strip $S_2$ having the thickness $h_2$ (here $h_2=0.4$ mm and $h_3=0.6$ mm). $C_{2,3}$ is the weld between the strips $S_2$ and $S_3$ where the strip thickness changes. The strip $S_3$ enters each zone after the strip $S_2$, so the strips $S_2$ and $S_3$ are called the preceding and following strips, respectively.

Step 1 (time $t_6$)

The strip $S_2$ with the thickness $h_2$ travels through the zones 1, 2 and 3 at the speed Vc. At this time, 80 percent or more of the actual length of the No. 1 preheating zone 1 is in operation. The actual temperature of the rapid-heating zone 3 is controlled so as to be at the optimum level preset for the strip $S_2$ having the thickness $h_2$. Therefore, the strip $S_2$ attains the desired temperature at the exit end of the rapid-heating zone 3.

Step 2 (time $t_7$)

When a point on the preceding strip $S_2$ which is ahead of the thickness-change point $C_{2,3}$ by a given length 1 reaches the entry end of the No. 1 preheating zone 1, the furnace temperature control system switches the preset temperature of the rapid-heating zone 3 from one for the preceding strip $S_2$ with the thickness $h_2$ to that for the following strip $S_3$ with the thickness $h_3$. At the same time, action to shorten the in-operation length of the No. 1 preheating zone 1 is started.

The change in actual furnace temperature resulting from the switching of the preset temperature is offset by the adjustment of the in-operation length of the No. 1 preheating zone 1 on the basis of estimation and feedback. Consequently, the preceding strip $S_2$ with the thickness $h_2$ leaving the rapid-heating zone 3 during the transition period, in which actual temperature of the rapid-heating zone 3 changes from the preset one for the strip $S_2$ with the thickness $h_2$ to the one for the strip $S_3$ with the thickness $h_3$, will attain the desired temperature.

Step 3 (time $t_8$)

When the thickness-change point $C_{2,3}$ reaches the entry end of the No. 1 preheating zone 1, the shortened in-operation length thereof is instantaneously returned to the longer, preset length. At this time, the rapid-heating zone thereof has reached the preset level for the following strip $S_3$ with the thickness $h_3$. Consequently, the following strip $S_3$ behind the changing point $C_{2,3}$ attains the desired temperature at the exit end of the rapid-heating zone 3.

The given length 1 is determined from the time it takes for the actual temperature of the rapid-heating zone 3 to change gradually from the optimum temperature for the preceding strip with the thickness $h_2$ to the optimum temperature for the following strip with the thickness $h_3$, and the preset transporting speed.

Between time $t_8$ and time $t_9$ at which that point on the preceding strip $S_2$ which is ahead of the thickness-change point $C_{2,3}$ by the actual length L of the No. 1 preheating zone 1 reaches the exit end of the rapid-heating zone 3, the strip $S_2$ leaves the rapid-heating zone 3 with the desired temperature, even if the actual temperature of the rapid-heating zone reaches the level which is optimum for the following strip $S_3$.

At time $t_{10}$, the changing point $C_{2,3}$ reaches the exit end of the rapid-heating zone 3. The following strip $S_3$ leaving the rapid-heating zone 3 after time $t_{10}$ attains the desired temperature, being preheated in the No. 1 preheating zone 1 with the preset in-operation length and then heated in the No. 2 preheating zone 2 and rapid-heating zone 3 the actual temperature of which is optimum for the strip with the thickness $h_3$.

At time $t_{12}$, the strip $S_3$ with the thickness $h_3$ travels steadily through the zones 1, 2 and 3.

Figure 6A:
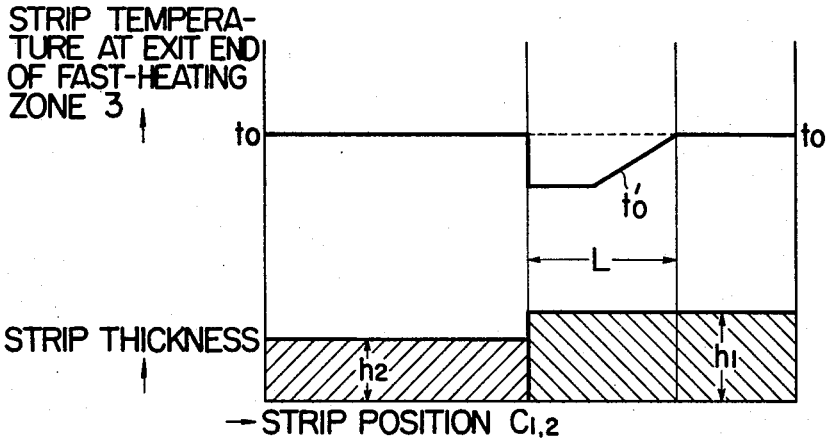
FIGS. 6A and 6D are graphs showing temperature distributions in the strip before and after the thickness-change point (the point at which two strips of different thickness are welded together), obtained at the exit end of the rapid-heating zone by the control method of this invention.
Figure 6B:
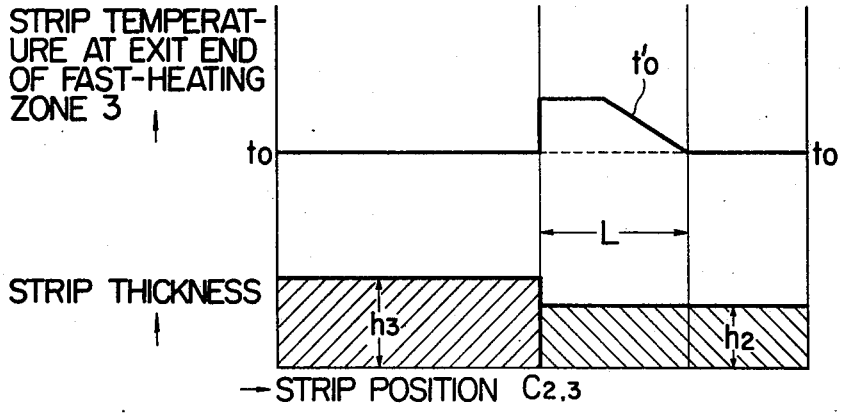

FIGS. 6A and 6B show the temperature distributions, ahead of and behind the thickness-change point (or the welded point), at the exit end of the rapid-heating zone 3, the No. 1 preheating zone 1. t'o designates the actual strip temperature at the exit end of the rapid-heating zone 3, and to is the desired strip temperature at the same point. As seen, the maximum length subjected to the incorrect temperature corresponds with the actual length L of the No. 1 preheating zone 1.

To sum up, the in-operation length of the No. 1 preheating zone 1 is shortened from the preset length when heavy-gauge strip is followed by light-gauge strip, and vice versa. In this example, this adjustment is done when the thickness-change point reaches the entrance of the No. 1 preheating zone 1. The maximum length of strip subjected to an incorrect temperature can likewise be confined within the actual length L of the No. 1 preheating zone 1 by making said adjustment when the thickness-change point reaches the exit end of or other selected point inside No. 1 preheating zone 1, too.

Figure 6C:
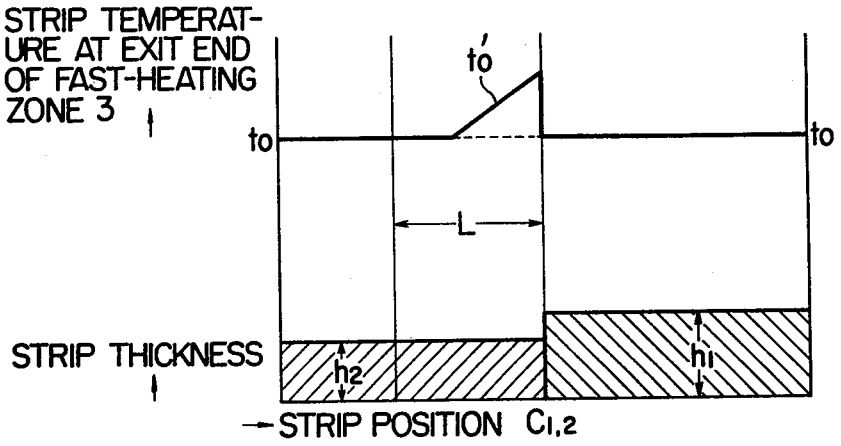
Figure 6D:
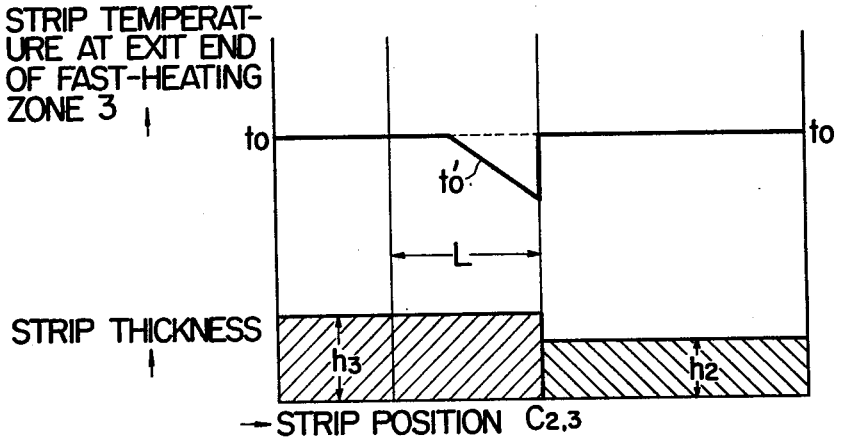

FIGS. 6C and 6D show the strip temperature distributions at the exit end of the rapid-heating zone 3 that are obtained by making said in-operation length adjustment when the thickness-change point reaches the exit end of the No. 1 preheating zone 1.

By thus changing the in-operation length of the No. 1 preheating zone 1 instantaneously when the thickness-change point of the strip reaches the entry or exit end of the No. 1 preheating zone 1 or other preliminarily selected point inside thereof, length of strip which is incorrectly heated can be held within the actual length L of the No. 1 preheating zone 1.

EXAMPLE II

In this example, the in-operation length of the No. 1 preheating zone 1 is preset at 50 percent of the actual length thereof.

When the thickness-change point reaches the entry end of the No. 1 preheating zone 1, the preset in-operation length thereof is increased or decreased by adjusting the number of the preheating units in operation. Then the exit temperature of the No. 1 preheating zone is controlled so that the following strip attains the desired temperature at the exit end of the rapid-heating zone 3, even if the actual temperature therein remains at the optimum temperature for the preceding strip.

Then, at a suitable time when the following strip travels steadily through the zones 1, 2 and 3, the temperature control system switches the preset temperature of the rapid-heating zone 3 from an optimum temperature for the preceding strip to an optimum temperature for the following strip. At the same time, the in-operation length of the No. 1 preheating zone 1 is adjusted to control the strip temperature at the exit end thereof. By this means, the following strip can attain the desired temperature at the exit end of the rapid-heating zone 3 even during a transitional period in which the actual temperature in the rapid-heating zone gradually changes to the one which is optimum for the following strip.

This method can limit the length of strip subjected to the incorrect temperature to within 50 percent of the actual length L of the No. 1 preheating zone 1.

The in-operation length of the No. 1 preheating zone 1 can be increased or decreased when the thickness-change point reaches the exit end of or other selected point inside the No. 1 preheating zone 1, too. Then the incorrectly heated length of strip is held within the actual length L of the No. 1 preheating zone 1.

EXAMPLE III

In this example, the in-operation length of the No. 1 preheating zone 1 is adjusted in accordance with, or by tracking the position of the thickness-change point $C_{1,2}$ or $C_{2,3}$ therein. Consequently, the length of incorrectly heated strip becomes equal to the length of a preheating unit.

Figure 7:
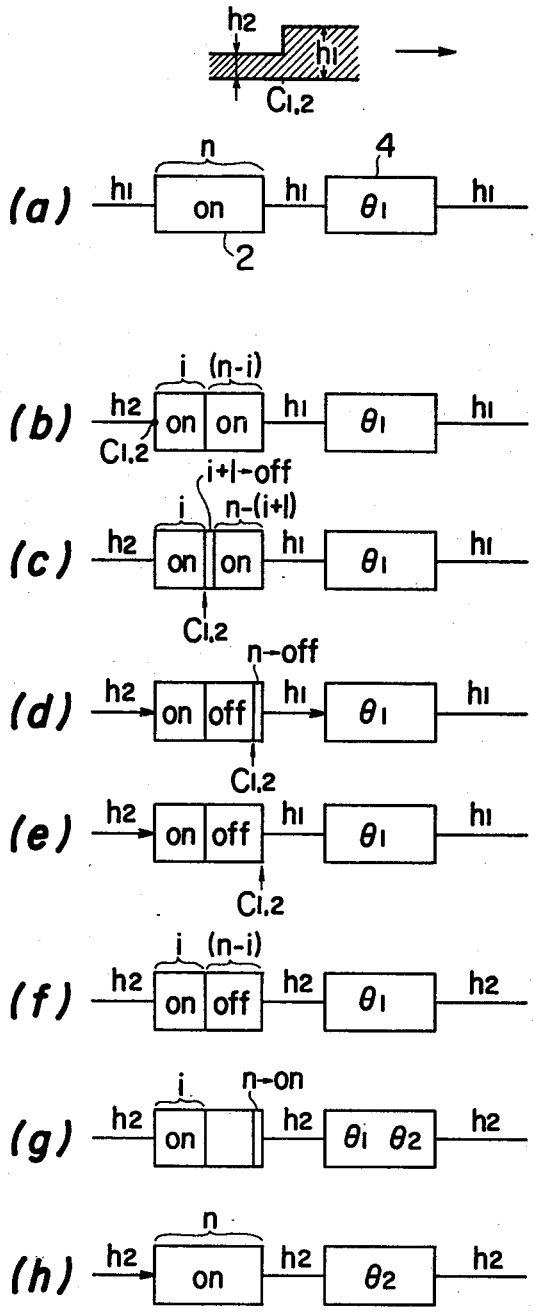
FIGS. 7(*a*)–7(*h*) are diagrams showing another embodiment of this invention, with the timing of the operation changing with the movement of the thickness-change point of the strip the thickness of which decreases.

Referring first to FIGS. 7(*a*)–7(*h*), the operation in which the strip thickness decreases from $h_1$ to $h_2$ will be described. In this figure, n denotes the number of preheating units in the No. 1 preheating zone 1, and $\theta_1$ and $\theta_2$ are the temperatures of the rapid-heating zone 3 which are optimum for the thicknesses $h_1$ and $h_2$, respectively. For convenience of illustration, the No. 2 preheating zone 2 is omitted. To leave a margin, the in-operation length of the No. 1 preheating zone 1 obtained by employing all n preheating units is established so as to be 80 percent of the full length thereof.

FIG. 7(*a*) shows a steady condition in which the strip $S_1$ with the thickness $h_1$ is passing through the No. 1 preheating zone 1 and rapid-heating zone 3. FIG. 7(*b*) shows a condition in which the thickness-change point $C_{1,2}$ just reaches the entrance of the No. 1 preheating zone 1. i is the number of preheating units to be adjusted to make possible heating the strip $S_2$ with the thickness $h_2$ to the desired temperature with the furnace temperature $\theta_1$. As shown in FIG. 7(*c*), the (i+1)th preheating unit is shut off when the thickness-change point $C_{1,2}$ passes the i-th preheating unit. Likewise, one preheating unit after another is shut off as the thickness-change point $C_{1,2}$ advances. In FIG. 7(*d*), the thickness-change point $C_{1,2}$ has reached a position immediately before the n-th preheating unit. In FIG. 7(*e*), the change point $C_{1,2}$ has just left the No. 1 preheating zone 1, and (n−i) preheating units are shut off. Consequently, the preceding strip $S_1$ leaves the rapid-heating zone 3 with the desired temperature at a point that is ahead of the change point $C_{1,2}$ by the length of a preheating unit. The strip $S_2$ behind the change point $C_{1,2}$ also leaves the rapid-heating zone 3 with the desired temperature.

In FIG. 7(*f*), the strip $S_2$ travels steadily through the No. 1 preheating zone 1 in which i preheating units are in operation and a rapid-heating zone 3 the temperature of which is set to be $\theta_1$. Then, as shown in FIG. 7(*g*), the preset temperature of the rapid-heating zone is changed from $\theta_1$ to $\theta_2$, whereupon the actual temperature in the rapid-heating zone starts to drop gradually. The number of the preheating units in operation is gradually increased from i in correspondence with the change in the rapid-heating zone temperature. As shown in FIG. 7(*h*), control should be exercised so that n preheating units have been put in operation when the rapid-heating zone temperature reaches $\theta_2$.

Figure 8:
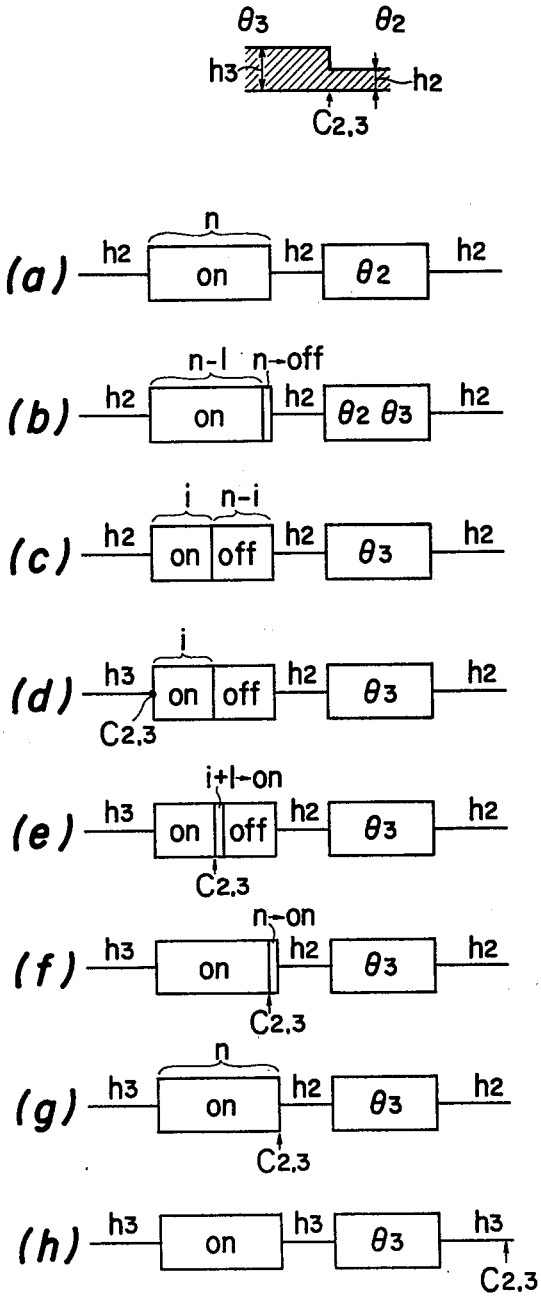
FIGS. 8(*a*)–8(*h*) are diagrams similar to those of FIGS. 7(*a*)–7(*h*), but for the case in which the strip thickness increases.

Referring now to FIGS. 8(*a*)–8(*h*), the operation in which the thickness of the strip S increased from $h_2$ to $h_3$ will be described.

FIG. 8(*a*) shows a steady condition in which the strip $S_2$ with the thickness $h_2$ passes steadily through the No. 1 preheating zone 1 and rapid-heating zone 3. Then the preset temperature of the rapid-heating zone 3 is changed from $\theta_2$ to $\theta_3$ before the thickness-change point $C_{2,3}$ reaches the No. 1 preheating zone 1, as shown in FIG. 8(*b*). Consequently, actual temperature of the rapid-heating zone 3 starts to rise gradually. This switching of the preset temperature should be effected at such a time as the change point $C_{2,3}$ reaches the entrance of the No. 1 preheating zone 1, or a little ahead thereof, just as the actual temperature of the rapid-heating zone 3 reaches $\theta_3$. The change point $C_{2,3}$ should not enter the No. 1 preheating zone 1 before that moment. Simultaneously, the operating preheating units in position n and therebeyond are shut off one after another in correspondence with the increase in the rapid-heating zone temperature.

In FIG. 8(*c*), i preheating units are in operation in the No. 1 preheating zone 1 when the rapid-heating zone temperature reaches $\theta_3$. In FIG. 8(*d*), the change point $C_{2,3}$ reaches the entrance of the No. 1 preheating zone 1. When the change point $C_{2,3}$ reaches a position immediately before the (i+1)th preheating unit, that unit is put in operation as shown in FIG. 8(*e*). As shown in FIGS. 8(*f*) and 8(*g*), the subsequent preheating units are likewise put in operation as the change point $C_{2,3}$ moves forward. Consequently, the preceding strip $S_2$ leaves the rapid-heating zone 3 with the desired temperature at a point that is ahead of the change point $C_{2,3}$ by the length of a preheating unit. The strip $S_3$ behind the change point $C_{2,3}$ also leaves the rapid-heating zone 3 with the desired temperature. FIG. 8(*h*) shows a steady condition in which the strip $S_3$ with the thickness $h_3$ passes steadily through the No. 1 preheating zone 1 and rapid-heating zone 3.

EXAMPLE IV

As in Example III, the in-operation length of the No. 1 preheating zone 1 is adjusted in accordance with, or by tracking, the position of the thickness-change point therein, but it is limited to 50 percent of the full length of the No. 1 preheating zone 1 under normal conditions. This example will be described by reference to FIGS. 9(*a*)-9(*h*).

Figure 9:
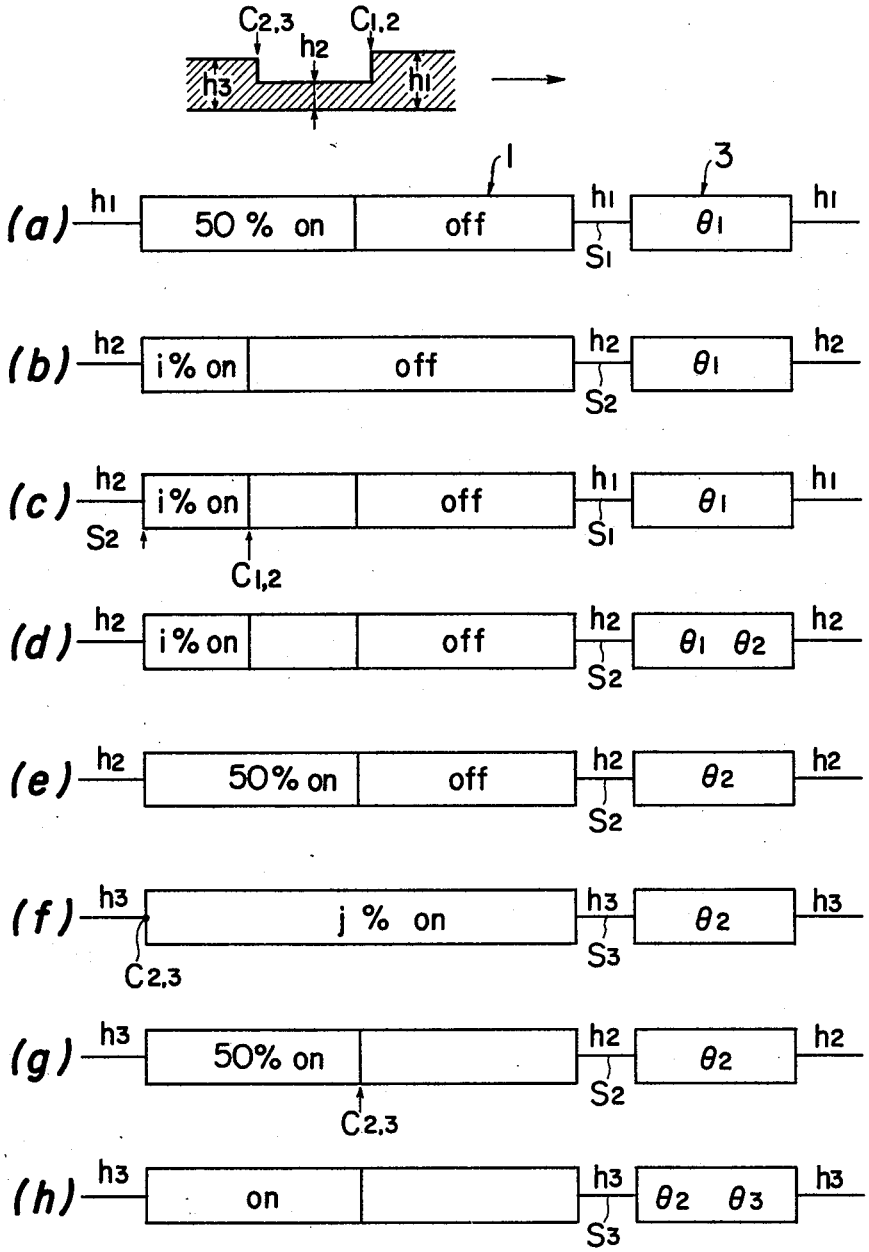
FIGS. 9(*a*)–9(*h*) are diagrams showing still another embodiment of this invention, with the timing of the operation for the moving thickness-change point.

First, the strip thickness decreases from $h_1$ to $h_2$. FIG. 9(*a*) shows a steady condition in which the strip $S_1$ with the thickness $h_1$ travels steadily through the No. 1 preheating zone 1 in which 50 percent of the preheating units are in operation and the rapid-heating zone 3 the temperature of which is maintained at $\theta_1$ preset at the optimum for the thickness $h_1$. In FIG. 9(*b*), the strip $S_2$ is heated in the rapid-heating zone 3 the temperature of which is kept at $\theta_1$. For the strip $S_2$ to attain the desired temperature under this condition, the in-operation length of the No. 1 preheating zone 1 should be reduced from 50 percent to i percent of the full length thereof. As shown in FIG. 9(*c*), the operating preheating units between the i-% position and the 50-% position are shut off one after another as the thickness-change point $C_{2,3}$ advances. When the strip $S_2$ enters the rapid-heating zone 3, the preset temperature thereof is switched from $\theta_1$ to $\theta_2$, and more preheating units are put into operation as the actual temperature in the rapid-heating zone 3 changes, as shown in FIG. 9(*d*).

Next, the thickness of the strip passing through the No. 1 preheating zone 1 and rapid-heating zone 3 increases from $h_2$ to $h_3$, as shown in FIG. 9(*e*) and therebeyond. In FIG. 9(*f*), the strip $S_3$ is heated in the rapid-heating zone 3 the temperature of which is maintained at $\theta_2$. For the strip $S_3$ to attain the desired temperature, the in-operation length of the No. 1 preheating zone 1 should be increased from 50 percent to j percent. As the thickness-change point $C_{2,3}$ moves beyond 50-% point, the preheating units therebeyond are put into operation one after another, as shown in FIG. 9(*g*). As shown in FIG. 9(*h*), the preset temperature of the rapid-heating zone 3 is switched from $\theta_2$ to $\theta_3$ when the strip $S_3$ enters the No. 1 preheating zone 1 and rapid-heating zone 3. Following this switching of the preset temperature, the actual temperature in the rapid-heating zone 3 rises gradually, and the in-operation length of the No. 1 preheating zone 1 is correspondingly reduced from j percent to 50 percent.

This method limits the length of the incorrectly heated strip to within the length of a preheating unit in the No. 1 preheating zone 1.

An application of this strip temperature control method to actual equipment will be described more concretely with reference to FIG. 2.

As shown in FIG. 2, the strip temperature is controlled by a control computer 51. This computer 51 is a general-purpose computer connected to a process input-output device 52 and a data-processing input-output device 53. Through the data-processing input-output device 53, the computer 51 memorizes the following:

1. Transporting speed Vc (fixed)
2. Optimum preset temperature for respective thicknesses in the rapid-heating zone 3 (corresponding to the temperature patterns shown in FIG. 3)
3. Desired strip temperature to at the exit end of the rapid-heating zone 3 (fixed)
4. Strip temperature ti at the entry end of the No. 1 preheating zone 1 (fixed)
5. Heating capacities of the preheating units in the No. 1 preheating zone 1 at the transporting speed Vc for respective thicknesses
6. Transporting order i, thickness hi and length li of each strip to be transported
7. Time for actual temperature in the rapid-heating zone 3 to respond to stepwise switching from one preset temperature to others by the furnace temperature control system
8. Lengths of the individual heating zones 1, 2 and 3, intervals therebetween, length of the preheating unit Zi in the No. 1 preheating zone 1, etc.

Through this process input-output device 52, the computer 51 receives strip thickness signals from a strip thickness detector (or a thickness-change point or weld detector) 13 at the entry end of the No. 1 preheating zone 1 and temperature signals from a strip temperature detector 14 at the exit end of the No. 1 preheating zone 1, a strip temperature detector 37 at the exit end of the rapid-heating zone 3, a combustion-gas temperature detector 38 in the rapid-heating zone 3, a waste-gas temperature detector 39 in the waste-gas collecting chamber 33, a strip temperature detector 27 at the exit end of the No. 2 preheating zone 2, and a waste-gas temperature detector 29 in the waste-gas collecting chamber 17.

In the steady condition wherein strip S with a uniform thickness is transported, temperatures of the No. 1 preheating zone 1, No. 2 preheating zone 2 and rapid-heating zone 3 are kept constant. The explanation will be started with the rapid-heating zone 3 and following the flow of heating gas. As mentioned before, the computer 51 memorizes optimum preset temperatures for various thicknesses for the rapid-heating zone 3, and outputs digital signals corresponding to strip thickness to the process input-output device 52. In this process input-output device 52, the digital signals are converted to analog signals, which are sent to a controller 43 of a fuel flow-rate regulating valve 42. The signals from the controller 43 open the fuel flow-rate regulating valve 42 as required, whereupon a required quantity of fuel is fed from a fuel source 41 to a burner 31. A flow meter 44 detects the flow rate and sends flow-rate signals to the controller 43 to permit feedback control of the fuel flow rate. The controller 43 inputs signals also through a ratio setter 48 to a controller 47 of an air flow-rate regulating valve 46. The signal from the controller 47 opens the air flow-rate regulating valve 46 as required.

A required quantity of combustion air preheated in the recuperator 15 is thus supplied to the burner 31. A flow meter 48 detects the flow rate and sends flow-rate signals to the controller 47 to enable feedback control of the air flow rate. The strip temperature measured by the temperature detector 37 at the exit end of the rapid-heating zone 3 is transferred through the process input-output device 52 back to the computer 51, whereby the temperature of the rapid-heating zone 3 is feedback-controlled.

After making temperature adjustment in the waste-gas collecting chamber 33, the waste gas from the rapid-heating zone 3 is supplied to the No. 2 preheating zone 2. This temperature adjustment is performed by controlling the flow rate of cold air, supplied from the blower 34 to the collecting chamber 33, by an air flow-rate regulating valve 35. The computer 51 sends a preset temperature signal of the No. 2 preheating zone 2 through the process input-output device 52 to a controller 36. Based on the signal from the controller 36, the air flow-rate regulating valve 35 supplies a required quantity of cold air to the waste-gas collecting chamber 33. Mixing with this cold air, the high-temperature waste gas from the rapid-heating zone 3 is cooled down to a desired level. The waste-gas temperature is feedback controlled on the basis of signals from the strip temperature detector 27 at the exit end of the No. 2 preheating zone 2 and the waste-gas temperature detector 39 in the waste-gas collecting chamber 33.

The strip temperature at the exit end of the No. 1 preheating zone 1 is controlled by adjusting the in-operation length of the preheating units therein. For this purpose, each preheating unit Zi must have an equal heating capacity. Heating gas is supplied to each preheating unit through an on-off regulating valve Vi. The temperature of the heating gas is adjusted by diluting the waste gas from the No. 2 preheating zone 2 with the waste gas from the No. 1 preheating zone 1. As described previously, the waste gas from the No. 1 preheating zone 1 is collected in the waste-gas collecting chamber 17, and then mixed with the waste gas from the No. 2 preheating zone 2 through a gas flow-rate regulating valve 22. Part of the waste gas from the waste-gas collecting chamber 17 is discharged into the atmosphere through a smokestack, and other part thereof is added to the mixed waste gas. The computer 51 sends control signals through the process input-output device 52 to the controllers 19, 21 and 23 of the waste-gas flow-rate regulating valves 18, 20 and 22, respectively. By thus adjusting the opening of the regulating valves 18, 20 and 22, the heating capacity of each preheating unit Zi is controlled to a given, equal level. By receiving signals from the strip temperature detector 14 at the exit end of the No. 1 preheating zone 1 and the waste-gas temperature detector 29 in the waste-gas collecting chamber 17, the computer 51 feedback-controls the heating capacity and in-operation length of the preheating units.

Next, an irregular operation with varying strip thickness will be described with reference to Example III described before, in which the strip thickness decreases.

Figure 10:
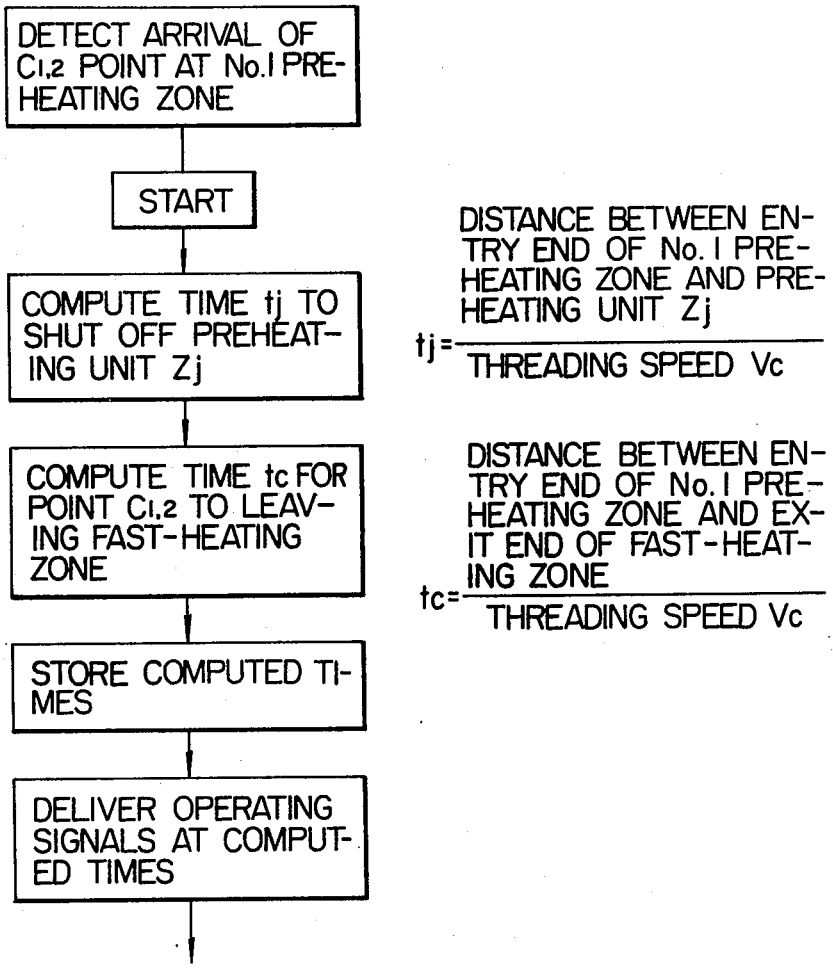
FIG. 10 is a flow chart for determining the time to shut off the preheating units in the No. 1 preheating zone in the embodiment of FIGS. 7(*a*)–7(*h*)

As shown in FIG. 7(*b*), the strip thickness detector 13 (see FIG. 2) detects the arrival of the thickness-change point $C_{1,2}$ between strips $S_1$ and $S_2$ at the entry end of the No. 1 preheating zone 1. The detection signal is inputted to the computer 51 through the process input-output device 52. Accordingly to the flow chart in FIG. 10, the computer calculates the time to shut off the (i+1)th preheating zone $Z_{i+1}$ in the No. 1 preheating unit, and times for shutting of zones $Z_{i+2}$ to $Z_n$. Because the transport speed Vc is fixed, the time can be determined by dividing the distance from the entrance of the No. 1 preheating zone 1 to each preheating unit Zi by the transport speed Vc. Likewise, the time at which the change point $C_{1,2}$ leaves the exit end of the rapid-heating zone 3 is calculated. The computer 51 stores these times, and sends a signal to an electromagnetic relay 12 (see FIG. 2) through the process input-output device 52 when each computed time is reached. The electromagnetic relay 12 closes a specific electromagnetic on-off regulating valve Zj, thereby shutting off a corresponding preheating unit Zi.

When the change point $C_{1,2}$ clears the rapid-heating zone 3 (this time can be determined by dividing the distance between the entry end of the No. 1 preheating zone 1 and the exit end of the rapid-heating zone 3 by the transport speed Vc), the preset temperature is switched from $\theta_1$ to $\theta_2$ as shown in FIG. 7(*g*). At the same time, the in-operation length of the No. 1 preheating zone 1 is gradually increased. At said computed time, the computer 51 delivers a presetting switching signal to the controller 43 of the fuel flow-rate regulating valve 42 through the process input-output device 52. This controls the quantities of fuel and combustion air fed to the burner 31, whereby the temperature of the rapid-heating zone 3 changes to the switched level.

Figure 11:
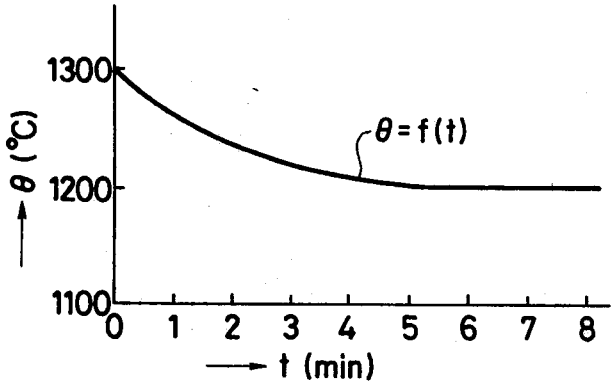
FIG. 11 is a graph showing the temperature change in the rapid-heating zone.

Because of its large heat capacity, the rapid-heating zone 3 requires a relatively long time, such as 5 minutes, to attain the new preset temperature. FIG. 11 shows a temperature curve $\theta=f(t)$ in the rapid-heating zone 3 that was determined by actual observation. As described before, the in-operation length of the No. 1 preheating zone 1 should be increased as the actual temperature in the rapid-heating zone 3 falls to the new level. The temperature $\theta_{SO}$ of the strip $S_2$ at the exit end of the rapid-heating zone 3 is expressed as follows:

$$\theta_{SO}=\theta-(\theta-\theta_{S1})e^{-mt} \quad (1)$$

where $\theta_{S1}$ = temperature of the strip $S_2$ at the entry end of the rapid-heating zone 3 (°C.)

$$m=\alpha S/C\gamma V$$

where $\alpha$ = coefficient of heat transfer (kcal/m$^2$hr°C.)

C = specific heat of the strip (kcal/kg°C.)

$\gamma$ = specific weight of the strip (kg°/m$^3$)

V + volume of the strip in the rapid-heating zone 3 (m$^3$)

S = surface area of the strip in the rapid-heating zone 3 (m$^2$)

Figure 12:
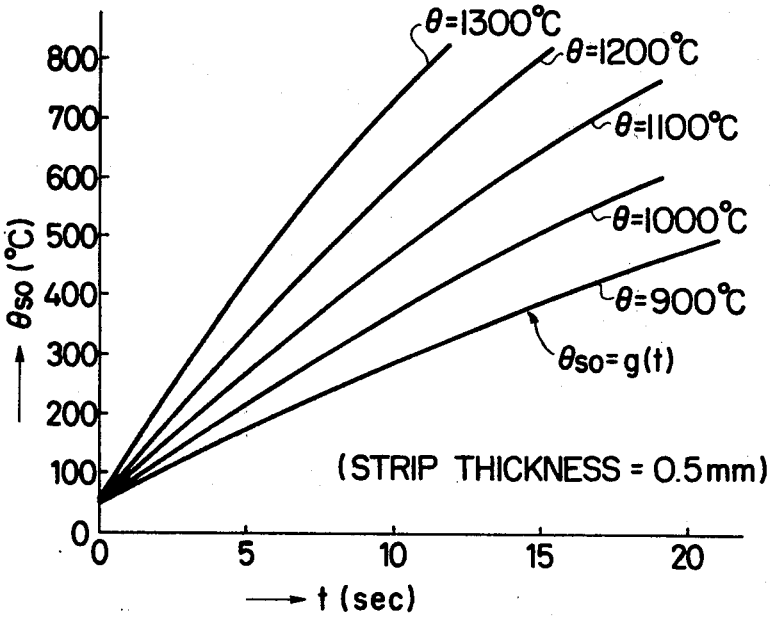
FIG. 12 is a graph showing how the strip temperature rises when the rapid-heating zone temperature is kept constant.
Figure 13:
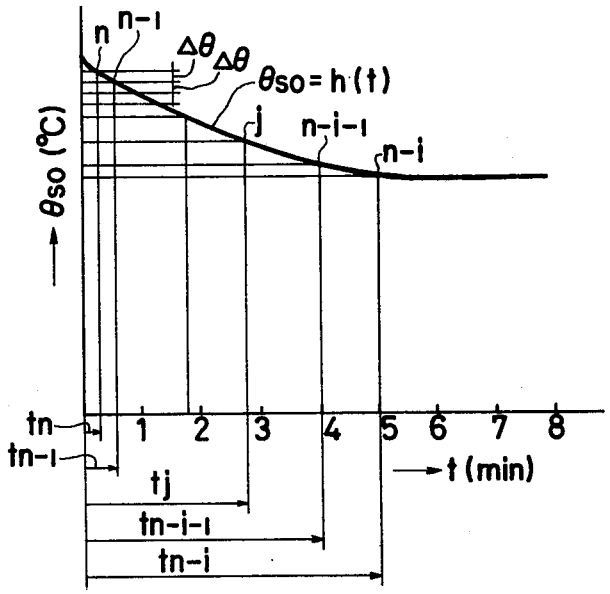
FIG. 13 is a graph showing the temperature change in the strip passing through the rapid-heating zone the temperature of which changes with time.
Figure 14:
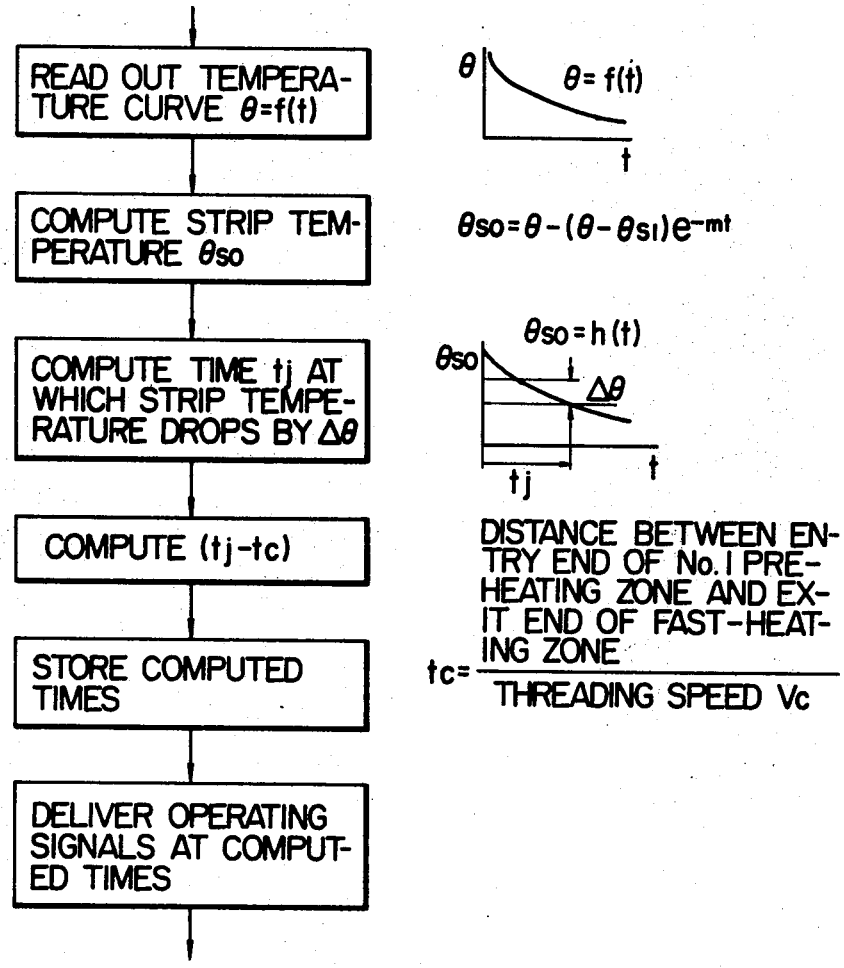
FIG. 14 is a flow chart for determing the time to increase the in-operation length of No. 1 preheating zone in accordance with with a time-wise change in the rapid-heating zone temperature in the embodiment of FIGS. 7(*a*)–7(*h*).

FIG. 12 shows a heat-up curve $\theta_{SO}=g(t)$ of the strip S (thickness h—0.5 mm) with a fixed zone temperature, calculated according to equation (1). Actually, however, the temperature $\theta$ in the equation (1) changes as shown in FIG. 11. Therefore, the strip temperature $\theta_{SO}$ should be determined with respect to varying zone temperature $\theta$. FIG. 13 shows a temperature curve $\theta_{SO}=h(t)$ determined with the varying zone temperature. As the strip temperature $\theta_{SO}$ falls with the time, the temperature decrement $\Delta\theta$ is offset by increasing the in-operation length of the No. 1 preheating zone 1. The decrement $\Delta\theta$ is made equal to the heating capacity (for example, 5° C.) of a preheating unit Zj, so that one preheating unit after another is put in operation for each temperature decrement $\Delta\theta$. In FIG. 13, $t_j$ shows the time needed to put in operation a preheating unit $Z_j$. In actual operation, the temperature curve $\theta = f(t)$ stored in the computer 51 is read out. Then the strip temperature $\theta_{SO}$ is calculated from equation (1), and the time $t_j$ at which the strip temperature $\theta_{SO}$ has fallen by $\Delta\theta$ is determined. When the time $t_j$ is reached, the preheating unit $Z_j$ is put in operation, after correcting time delay to due to the distance between the exit ends of the No. 1 preheating zone 1 and the rapid-heating zone 3. Thus, the temperature of the strip leaving the No. 1 preheating zone 1 is feedforward-controlled, and the strip leaving the rapid-heating zone 3 is heated to the desired temperature.

The above-described control following the strip thickness change may be exercised after decreasing the transporting speed, furnace temperature and in-operation length of the preheating units.

As understood from the above, the controlling method of this invention is best-suited for continuous high-speed strip heating systems in which strip of varying thicknesses is heated at heating rates as high as 100° C. per second or above. In a continuous annealing operation, for instance, it is desirable from the standpoint of strip quality to heat the strip at as high a rate as possible within a given temperature range, such as between 400° C. and 700° C. Within this temperature range, for example, the control method of this invention permits continuously heating transported strip of varying thickness to the desired temperature at a heating rate of 100° C. per second or above. Because it causes no yield reduction, this high-rate operation provides a great commercial advantage.

We claim:

1. A method of controlling steel strip temperature in continuous heating equipment having a preheating zone and a subsequent rapid heating zone through which a strip having different thicknesses and prepared by welding together strips of different thickness is continuously transported at a fixed speed so that the strip temperature constantly reaches a given desired temperature at the exit end of the rapid heating zone irrespective of strip thickness, which method comprises:

arranging a number of individually controllable preheating units side-by-side in the preheating zone in the direction of strip travel for directing heating gas against the strip;

prefixing the in-operation length of the preheating zone irrespective of strip thickness for operation of the equipment for heating uniform thickness strip;

presetting the temperature of the rapid-heating zone according to the thickness of uniform thickness strip which is to be heated in said equipment so that the strip constantly acquires the desired temperature at the exit end thereof;

preheating uniform thickness strip during transport of the strip in the preheating zone of the prefixed in-operation length and then rapidly heating the strip in the rapid heating zone which is at the preset temperature to attain the desired strip temperature at the exit end of said equipment; and when transporting strip having a preceding portion having one thickness for which the operating conditions of the equipment have been set and a following portion having a different thickness from that of the preceding portion and which is connected to said preceding portion, changing the preset temperature of the rapid heating zone from that for the preceding portion to a temperature optimum for the following portion and adjusting the in-operation length of the preheating zone, during the transitional period in which the actual temperature of the rapid heating zone changes to the second preset level, to attain the desired strip temperature at the exit end of said equipment.

2. A method of controlling steel strip temperature according to claim 1 in which the step of changing the preset temperature of the rapid heating zone and adjusting the in-operation length of the preheating zone comprises:

quickly decreasing, when a heavy gauge strip portion is followed by a light gauge strip portion, the in-operation length of the preheating zone when the thickness change point of the strip reaches a predetermined one of a plurality of points in said preheating zone including the entry and the exit ends of the preheating zone for giving to the strip at the end of the preheating zone a temperature such that it will be heated to the desired strip temperature bu the time it reaches the exit end of the rapid heating zone, and switching the preset temperature of the rapid heating zone after the thickness change point has left the rapid heating zone to the preset temperature for the light guage strip portion; and switching, when a light gauge strip portion is followed by a heavy gauge strip portion, the preset temperature of the rapid heating zone to the predetermined temperature for the heavy gauge strip before the thickness change point reaches the entry end of the preheating zone, and at the same time reducing the in-operation length of the preheating zone, and then quickly increasing the in-operation length of the preheating zone when the thickness change point reaches a predetermined one of a plurality of points in said preheating zone including the entry and exit ends of the preheating zone for giving to the strip at the end of the preheating zone a temperature such that it will be heated to the desired strip temperature by the time it reaches the exit end of the rapid heating zone.

3. A method of controlling steel strip temperature as claimed in claim 1, in which the in-operation length of the preheating zone is limited, when the strip being transported has a uniform thickness, to 50 percent of the full structural length thereof; and the step of changing the preset temperature of the rapid heating zone and adjusting the in-operation length of the preheating zone comprises quickly increasing or decreasing the in-operation length of the pre-heating zone when the thickness change point reaches a predetermined one of a plurality of points in said preheating zone including the entry and exit ends of the preheating zone for giving to the strip at the end of the preheating zone a temperature such that it will be heated to the desired strip temperature by the time it reaches the exit end of the rapid heating zone; and switching the preset temperature of the rapid heating zone to the predetermined temperature for rapid heating of the following portion of the strip when the thickness change point has left the rapid heating zone.

4. A method of controlling steel strip temperature as claimed in claim 2 or 3 in which the step of quickly increasing or decreasing the in-operation length of said preheating zone comprises quickly starting up or quickly shutting down successive preheating units as the thickness change point passes the successive preheating units.

5. A method of controlling steel strip temperature according to claim 2 in which the step of quickly increasing or decreasing the in-operation length of the preheating zone comprises quickly increasing or decreasing the in-operation length of the preheating zone by tracking the thickness change point in the preheating zone and turning respective units on or off when the thickness change point arrives thereat.

6. A method of controlling steel strip temperature as claimed in claim 2 or claim 3 which further comprises gradually changing the in-operation length of said preheating zone as the temperature of the rapid heating zone changes after switching of the preset temperature thereof for changing the temperature of the strip of the exit end of the preheating zone in the opposite sense from that in which the temperature in the rapid heating zone is changing.

7. A method of controlling steel strip temperature as claimed in claim 6 in which the step of gradually changing the in-operation length of said preheating zone comprises actuating or deactuating successive preheating units at intervals at which the strip temperature at the exit end of the rapid heating zone is estimated to change by an amount equivalent to that attributable to the heating capacity of the respective preheating units.

8. A method controlling steel strip temperature according to claim 1 in which the steps of prefixing the in-operation length of the preheating zone and changing the preset temperature of the rapid-heating zone comprises:

making the in-operation length of the preheating zone approximately that of the full zone length when uniform thickness strip is passing through the heating equipment;

tracking the thickness change point of the strip;

quickly making, when a heavy gauge strip portion is followed by a light gauge strip portion, the in-operation length of the preheating zone shorter than the prefixed in-operation length so that the strip temperature of the following portion at the exit end of the rapid-heating zone reaches a desired level when the thickness change point reaches a predetermined position in the preheating zone, and changing the preset temperature of the rapid-heating zone after the thickness change point has left the rapid-heating zone; and changing, when a light gauge strip portion is followed by a heavy gauge strip portion, the preset temperature of the rapid-heating zone before the thickness change point reaches the preheating zone, and at the same time reducing the in-operation zone, and then quickly increasing the in-operation length of the preheating zone to the prefixed in-operation length so that the strip temperature of the following portion at the exit end of the rapid-heating zone reaches a desired level when the thickness change point reaches a predetermined position in the preheating zone.

9. A method of controlling steel strip temperature according to claim 1 in which the steps of prefixing the in-operation length of the preheating zone and changing the preset temperature of the rapid-heating zone comprises:

making the in-operation length of the preheating zone about 50 percent of the full zone length when uniform thickness strip is passing through the heating equipment;

tracking the thickness change point of the strip;

quickly increasing or decreasing the in-operation length from the prefixed in-operation length so that the strip temperature of the following portion at the exit end of the rapid-heating zone reaches a desired level when the thickness change point reaches a predetermined position in the preheating zone; and changing the preset temperature of the rapid-heating zone after the thickness change point has left the rapid-heating zone.

* * * * *

UNITED STATES PATENT AND TRADEMARK OFFICE

CERTIFICATE OF CORRECTION

PATENT NO. : 4,239,483

DATED : December 16, 1980

INVENTOR(S) : Hiroshi Iida; Ikuo Umehara; Yasuo Takeda

It is certified that error appears in the above-identified patent and that said Letters Patent are hereby corrected as shown below:

Column 20, line 21 for "bu" read --by--.

Signed and Sealed this

Fourteenth Day of July 1981

[SEAL]

Attest:

GERALD J. MOSSINGHOFF

Attesting Officer

Commissioner of Patents and Trademarks